US006116937A

United States Patent [19]

Pan

[11] Patent Number: 6,116,937

[45] Date of Patent: Sep. 12, 2000

[54] FASTENER FOR CONNECTORS

[75] Inventor: Long-Jyh Pan, Taipei, Taiwan

[73] Assignee: Acer Peripherals, Inc., Taoyuan, Taiwan

[21] Appl. No.: 09/337,527

[22] Filed: Jun. 22, 1999

[30] Foreign Application Priority Data

Nov. 6, 1998 [TW] Taiwan ..... 87218403

[51] Int. Cl.[7] ..... H01R 13/627

[52] U.S. Cl. ..... 439/352

[58] Field of Search ..... 439/352, 357, 439/353, 358, 354, 355, 356, 140, 350

[56] References Cited

U.S. PATENT DOCUMENTS 5,997,334 12/1999 Goto ..... 439/352

*Primary Examiner*—Paula Bradley
*Assistant Examiner*—Phuong Nguyen
*Attorney, Agent, or Firm*—Dougherty & Troxell

[57] ABSTRACT

A fastener for connectors includes a body consisting of an insert engageable with a socket and a latch member having at least one latch finger along a lateral side of the insert. A latch arm is located outside the latch finger. A wedge motion means is located between the latch member and the latch arm for converting transverse motion of the latch arm to a downward motion of the latch finger for engaging or releasing the insert from the socket.

11 Claims, 3 Drawing Sheets

FASTENER FOR CONNECTORS

BACKGROUND OF THE INVENTION

1. Field of the Invention

This invention relates to a fastener for connectors and particularly to a fastener that has a novel latching means for facilitating users to fasten the connector single-handedly.

2. Description of the Prior Art

In electronic industry, connectors are widely used for fastening signal or electric cables to the sockets on electronic or electric devices. Some fastening means in the art are usually used to connect the connectors securely with the socket. Screw nut-and-bolt is one of the commonly used fastening means (e.g., for connecting a computer interface card with a cable). Snap button means is another example commonly used in multi-purpose power supply connectors for fastening two separate members together. Latch fastening means is yet another example commonly used in cellular phone or small electronic devices for connecting cables.

Generally speaking, screw nut-and-bolt has strong fastening power. It is the best means for large or heavy weight devices that need greater binding strength. However, since nuts and bolts have specific size and dimension, they are not suitable for small devices or devices whose smooth appearance is one of its critical design factors.

The snap button means, which are commonly used in multi-purpose power supply connectors, usually has an engaging slot located at one member and a push button and a hook located at another member. The push button and the hook need a third supporting means such as pivotal shaft, spring, and button stem to work together. Thus, it needs a lot of space. Therefore, it is mostly used in devices that have relatively large size.

The latch fastening means usually includes a simple component attached directly to the connector. It utilizes the component shape as a fastening element to engage or disengage two separate members. It is a very simple and low cost connecting solution, which is widely used now.

FIG. 1 illustrates a fastener using conventional latch means. The fastener 1 includes a body 10 and a fastening member 20 wrapped around the body 10. The body 10 includes an insert 11 at one end engageable with a slot opening 101 of a socket 100, and a connection end 13 at another end thereof for coupling with an electric or signal cable 131. The insert 11 can be electrically connected with the connection end 13 within the body 10. The fastening member 20 is usually manufactured by stamping a thin plate. It has a pair of latch fingers 21 located at two lateral sides of the insert 11. Each latch finger 21 has a hook 211 at the free end thereof above a top wall 110 of the insert 11. Another ends of the latch fingers 21 form a common root section 210 which has a bulge 23 formed on the top thereof.

When in use, a user holds the fastener 1 by one hand, using the thumb and the middle finger to clamp around the fastening member 20 at both lateral sides thereof and using the forefinger to press the bulge 23 downward. The root section 210 and the latch fingers 21 will be pressed down and lower the hook 211 below the top wall 110. Then, the insert 11 may be slipped into the slot opening 101 of the socket 100 until the hooks 211 reaching two wedge cuts 103 located at two interior lateral sides of the socket 100. After the forefinger release the bulge 23, the root section 210 and the latch fingers 21 will bounce back to their original positions. The hooks 211 will bounce upward again above the top wall 110 and engage with the wedge cuts 103. The fastener 1 thus engages firmly with the socket 100 for establishing electrical connection of the cable 131 with the socket 100. The hooks 211 may have a sloped upper edge in the front. Then, pushing the insert 11 into the slot opening 101 will enable the hooks 211 to be pressed downward by an upper edge of the slot opening 101, so that the insert 11 may engage with the socket 100 without the forefinger pressing the bulge 23. However, for disengaging the insert 11 from the socket 100, pressing the bulge 23 by the forefinger is a necessary step. It is this step causes concern to many people. Because of physical property of human being, it is awkward and not comfortable to apply force by the forefinger to press the bulge 23 under that condition. As a matter of fact, there is room for improvement regard this matter.

SUMMARY OF THE INVENTION

In view of aforesaid disadvantages, it is an object of this invention to provide a fastener for connectors that has a novel latching means to enable users to fasten or disengage a connector single-handedly and easily.

The fastener of this invention changes force application direction used to engage or disengage the connector so that users may operate the fastener more effectively with less effort. In one aspect, the fastener of this invention has a body and a fastening member that includes a latch body and two latch arms. The body has a pair of spaced latch fingers that each of them has respectively a hook at one end for engaging with a socket. The latch arms located beyond two lateral sides of the latch body may move the latch fingers up or down to engage or disengage with the socket.

According to another aspect of this invention, there is a wedge motion means located between the latch body and latch arm for converting lateral force applied on the latch arm to a respective perpendicular force on latch fingers for fastening or disengaging the socket.

According to an embodiment of this invention, the wedge motion means may include a pair of bulges located at a root section of the latch body and two flanges transversely extending from the latch arms. Each bulge has a slant surface engageable with one of the flanges. When the latch arms are pressed transversely to move against the bulges, the bulges will be pressed downward; and so is the root section. Then, the latch fingers will be moved downward as well. Through such a structure and function, engagement or disengagement with the socket may be achieved by a user single-handedly. The bulge may be shaped like an arch, a wedge, or the like.

The wedge motion means may have various embodiments and can still achieve the desired result. Instead of bulges, the root section may have a slant corner to engage with the flange, or have a slant flange engages with a round comer of the root section.

BRIEF DESCRIPTION OF THE DRAWINGS

The invention, as well as its many advantages, may be further understood by the following detailed description and drawings in which.

DETAILED DESCRIPTION OF THE PREFERRED EMBODIMENT

Figure 2:
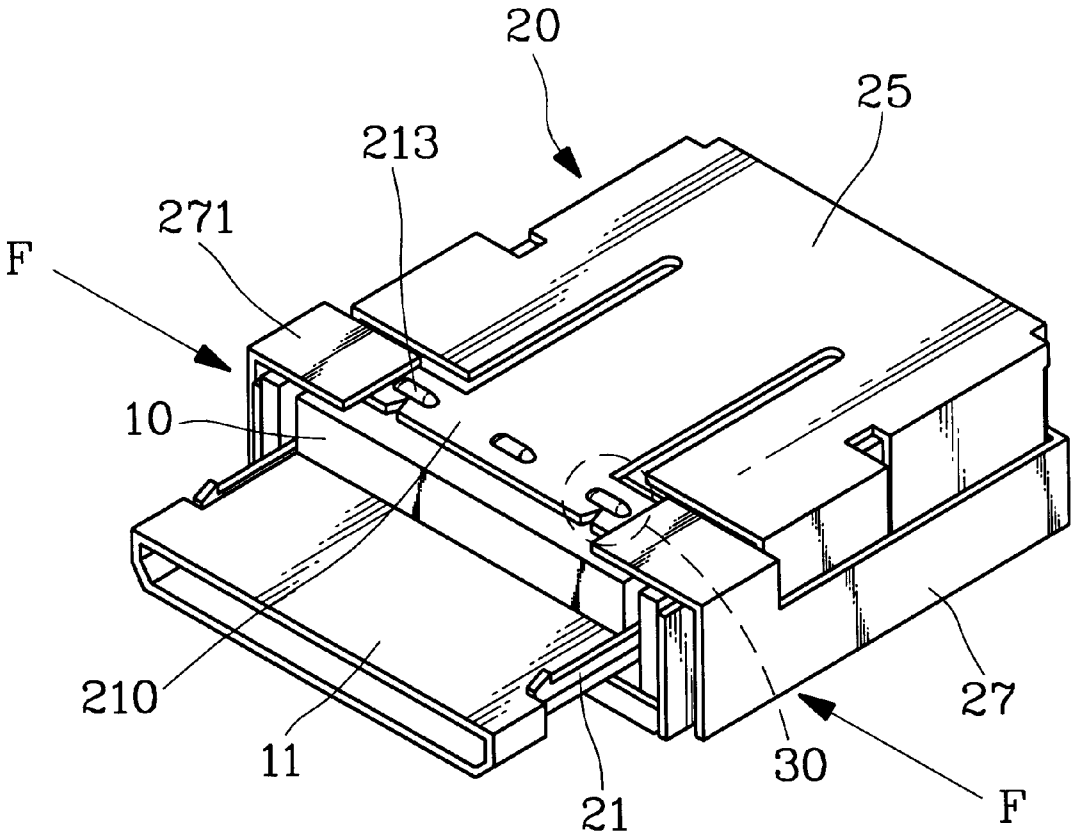
FIG. 2 is a perspective view of a first embodiment of this invention.

FIG. 2 illustrates a first embodiment of this invention. The fastener 20 according to this invention includes a body 10, an insert 11 located at the front end of the body 10 for engaging with a socket (not shown in the figure), a latch member 25 and a pair of latch arms 27 located beside the lateral sides thereof.

At the front end of the two lateral sides of the latch member 25, there are a pair of spaced latch fingers 21 extended along two lateral sides of the air insert 11. Each of the latch finger 21 has respectively a hook at the front end thereof. The hook is preferably located right above the top surface of the insert 11. Another end of the latch finger 21 is extended from respective lateral side of a root section 210, at which forms a front end of the latch member 25.

The latch arms 27 are located outside the latch member 25 and spaced from the respective lateral side. Between the latch arms 27 and the latch member 25, there are provided with a pair of wedge motion means 30. Upon pressing the latch arms 27 transversely toward the center of the body 10, the wedge motion means 30 will be pushed downward. The root section 210 and the latch finger 21 will also be moved downward. Then, the insert 11 may be freed to insert into a socket or be freed to move out of a socket. When the pressing force upon the latch arms 27 relieved, the wedge motion means 30 will bounce upward to their original positions. As a consequence, the root section 210 and the latch fingers 21 will also return to their original positions. With these positions, the fastener 20 can be either engaged with the socket if the insert 11 is held in the socket, or separated from the socket if the insert 11 is disengaged with the socket.

Figure 1:
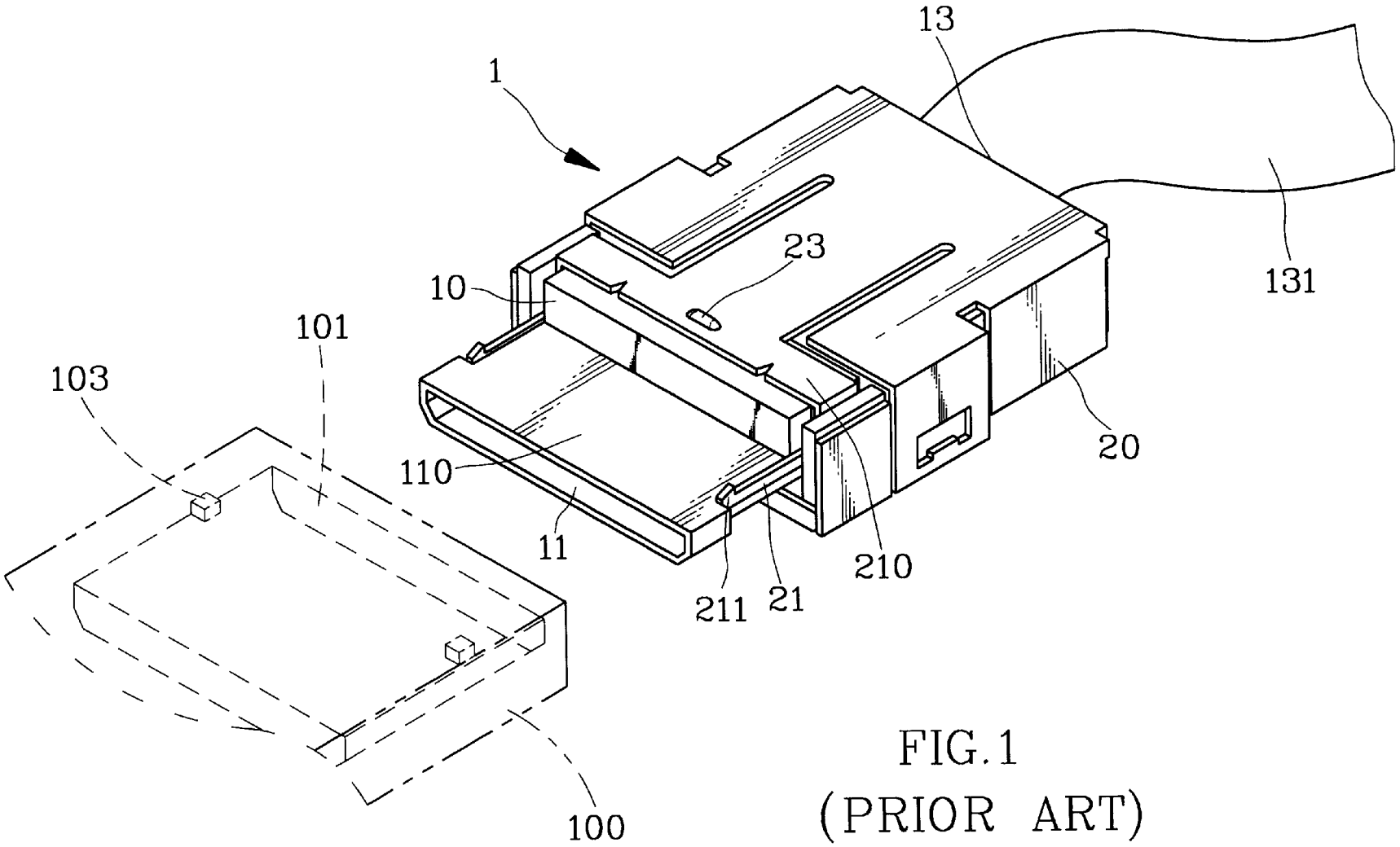
FIG. 1 (PRIOR ART)
FIG. 1 is a perspective view of a conventional fastener for connection.

In the first embodiment shown in FIG. 2, the wedge motion means 30 includes a pair of bulges 213 located at the root section 210 and a pair of transverse flanges 271 extending from the front ends of the latch arms 27 to be close to the corresponding bulges 213. Each bulge 213 has a slope surface touchable with the front edge of the flange 271. Upon pressing the latch arms 27 with the thumb and the rest fingers of a hand transversely, the flanges 271 will be pressed inward and against the bulges 213 to push them downward. The root section 210 as well as the latch fingers 21 will be moved downward. Then, the insert 11 may freely engage with the socket or may be removed from the socket. Such an operation requires only one hand to squeeze the fastener 20 in a single direction, in contrast that two force application directions of a hand are needed for pressing the root section 210 in the aforesaid conventional fastener shown in FIG. 1. Apparently, the fastener in accordance with the present invention works with less human effort.

Figure 3:
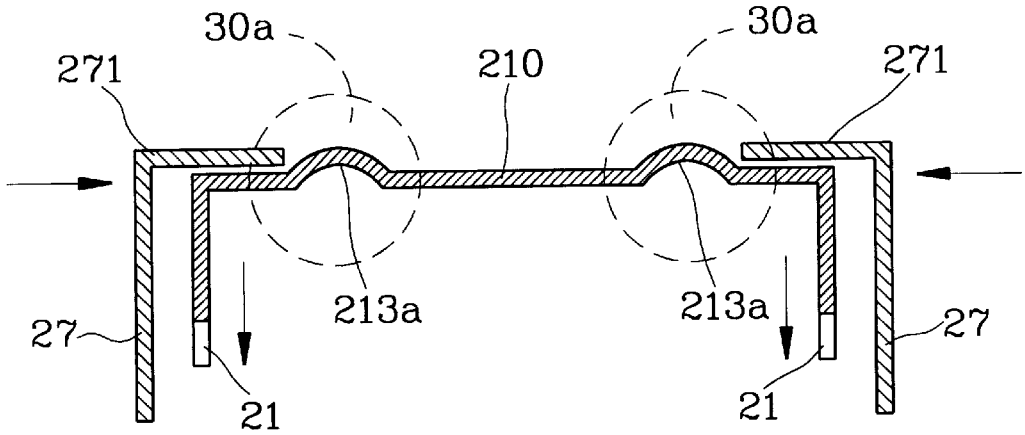
FIG. 3 is a fragmentary sectional view of a second embodiment of this invention.

FIG. 3 illustrates a second embodiment of this invention. It is constructed substantially like the first embodiment set forth in FIG. 2. However, instead of wedged bulges 213 with a slope top surface, a pair of arched shape bulges 213*a* are used on the wedge motion means 30*a*. The application of the second embodiment is similar to that of the first embodiment disclosed above.

Figure 4:
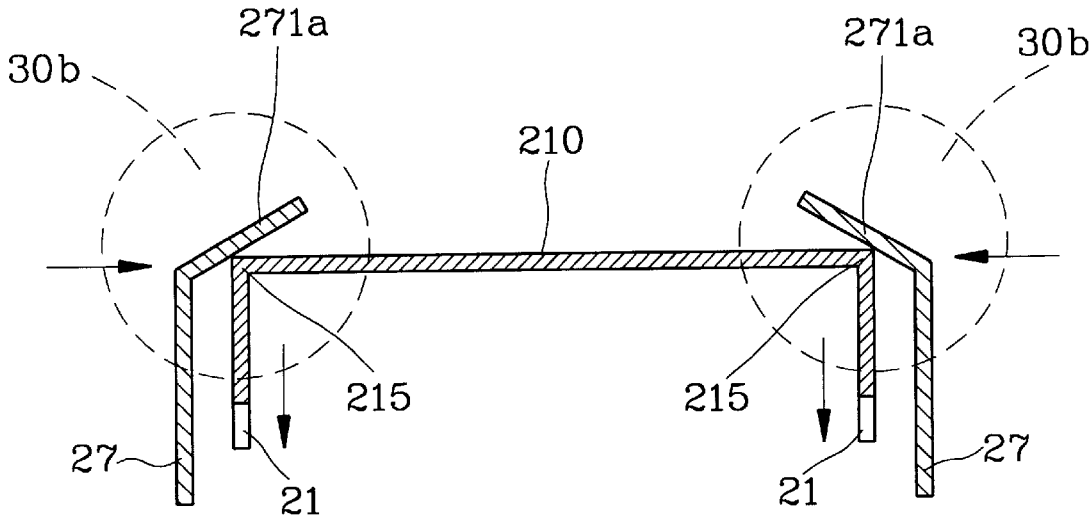
FIG. 4 is a fragmentary sectional view of a third embodiment of this invention.

FIG. 4 illustrates a third embodiment of this invention. It employs same principle as the first embodiment, except that the wedge motion means 30*b* are different. Instead of bulges 213 and transverse flanges 271, the front end of the root section 210 has two lateral corners 215 at the edges of the top surface and the side surfaces thereof. The flanges 271*a* of the latch arms 27 contact with the corners 215. Upon pressing the flanges 271*a* inward, the corners 215 as well as the latch fingers 21 extending from the root section 210 will be pushed downward, so that an engagement or disengagement operation between the fastener and a socket can be proceeded. According to the present invention, the corners 215 may be in other suitable forms; such as smooth angles, obtuse angles, or the like.

Figure 5:
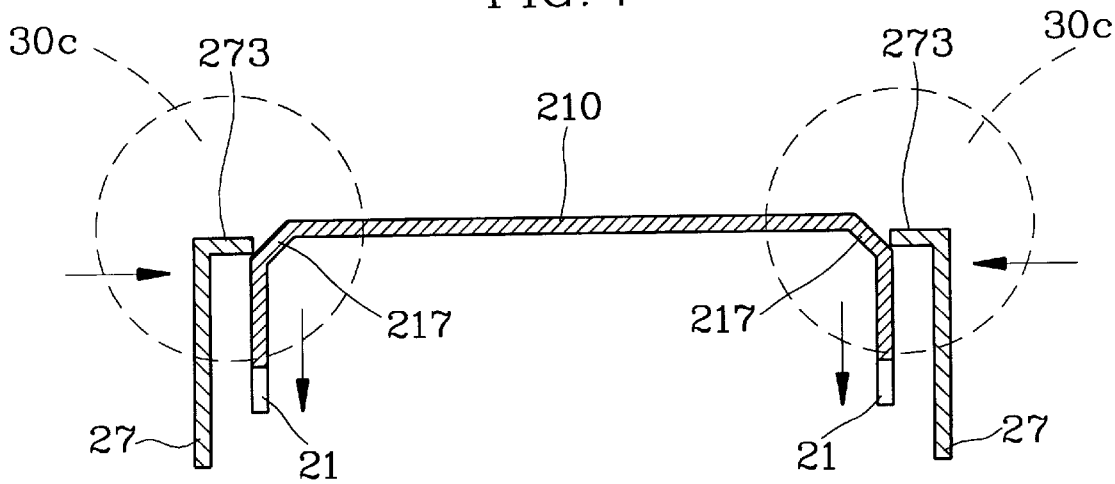
FIG. 5 is a fragmentary sectional view of a fourth embodiment of this invention.

FIG. 5 shows a fourth embodiment using yet another form of wedge motion means 30*c*. In this embodiment, the root section 210 has two cut corners 217 at two lateral sides that are touchable with two transverse flanges 273 of the respective latch arms 27. The application of the fourth embodiment is similar to that of the third embodiment disclosed above.

In summary, this invention is ergonomically designed and enables a user to use a single hand to operate the fastener easily and simply in engaging or disengaging a connector.

It may thus be seen that the objects of the present invention set forth herein, as well as those made apparent from the foregoing description, are efficiently attained. While the preferred embodiments of the invention have been set forth for purpose of disclosure, modifications of the disclosed embodiment of the invention as well as other embodiments thereof may occur to those skilled in the art. Accordingly, the appended claims are intended to cover all embodiments that do not depart from the spirit and scope of the invention.

What is claimed is:

1. A fastener for connectors, every connector having a main body and a front insert, comprising:

a latch member, formed separately and outside the main body, including at least one latch finger located along a lateral side of the insert, the latch finger having a root end extending to a side wall of the body;

a latch arm located outside the root end of the latch finger; and a wedge motion mechanism located between the latch member and the latch arm for converting transverse motion of the latch arm to vertical motion of the latch finger, wherein the wedge motion mechanism includes a bulge located on a top surface of the root end of the latch finger, and a transverse flange extended from a top side of the latch arm, the bulge having a slope surface touchable with the flange and moving downwards when the flange is moved transversely toward a center of the body.

2. The fastener of claim 1, wherein the bulge is formed as an arch shape.

3. The fastener of claim 1, wherein the bulge is formed as a wedge shape.

4. The fastener of claim 1, wherein the wedge motion means includes a corner at a lateral edge of a top surface of the latch member and a slant flange of the latch arm touchable with the corner for moving the corner and the latch finger downwards when the slant flange being moved transversely toward a center of the body.

5. The fastener of claim 4, wherein the corner is a round corner.

6. The fastener of claim 1, wherein the wedge motion means includes a slant edge at a lateral edge of a top surface of the latch member and a transverse flange touchable with the slant edge for moving the slant edge and latch finger downwards when the transverse flange being moved transversely toward a center of the body.

7. A fastener for fastening a connector onto a socket, comprising:

a latch finger being able to vertically swing between a first position for fastening the connector with the socket and a second position for releasing the connector from the socket;

the latch finger including a root portion having a top surface and a lateral surface;

a wedge motion means formed on the top surface of the root portion;

a latch arm being able to substantially horizontally slide along the top surface of the root portion between a third position and a forth position; and a flange formed on the latch arm, the flange extended above the top surface of the root portion and being able to push the wedge motion means downwards when the latch arm is sliding from the third position toward the forth position, so as to make the latch finger swing from the first position toward the second position.

8. The fastener of claim 7, wherein the wedge motion means is a slant surface formed on the root portion to be pushed by the flange to make the latch finger swing downwards.

9. The fastener of claim 8, wherein the slant surface is formed on the corner between the top surface and the lateral surface of the root portion.

10. The fastener of claim 8, wherein the slant surface is arch-shaped and formed on the top surface of the root portion.

11. A fastener for fastening a connector onto a socket, comprising:

a latch finger being able to vertically swing between a first position for fastening the connector with the socket and a second position for releasing the connector from the socket;

the latch finger including a root portion having a top surface and a lateral surface;

a latch arm being able to substantially horizontally slide along the top surface of the root portion between a third position and a forth position; and a slant flange formed on the latch arm, the slant flange extended above the top surface of the root portion to push the top surface of the root portion downwards when the latch arm is sliding from the third position toward the forth position, so as to make the latch finger swing from the first position toward the second position.

* * * * *